United States Patent [19]

Rao et al.

[11] Patent Number: 4,613,443

[45] Date of Patent: Sep. 23, 1986

[54] NONCONDUCTING THREAD LUBRICANT

[75] Inventors: M. Vikram Rao; Manmohan S. Kalsi, both of Houston; Patricio D. Alvarez, Rosenberg, all of Tex.

[73] Assignee: NL Industries, Inc., New York, N.Y.

[21] Appl. No.: 625,381

[22] Filed: Jun. 28, 1984

[51] Int. Cl.[4] ..... C10M 131/04; C10M 141/00

[52] U.S. Cl. ..... 252/21; 252/26; 252/58

[58] Field of Search ..... 252/21, 26, 58

[56] References Cited

U.S. PATENT DOCUMENTS 2,543,741 2/1951 Zweifel ..... 252/26
3,309,313 3/1967 Callahan, Jr. ..... 252/26
3,526,593 9/1970 Oliver et al. ..... 252/18
4,379,062 4/1983 Prengaman ..... 252/26

*Primary Examiner*—Jacqueline V. Howard
*Attorney, Agent, or Firm*—Carl O. McClenny; William E. Johnson, Jr.

[57] ABSTRACT

A nonconducting pipe thread lubricating composition for use in a drill string capable of transmitting electrical signals from a downhole location to the surface of the earth. The composition includes hard and soft moderately deforming materials such as polyphenylene sulfide and talc, and a lubricating solid such as polytetrafluoroethylene dispersed in a viscous lubricating base preferably a lithium based grease.

8 Claims, No Drawings

NONCONDUCTING THREAD LUBRICANT

BACKGROUND OF THE INVENTION

This invention relates to lubricants for use in the drill pipe tool joints and collar connections. More particularly, it relates to thread lubricants for rotary shouldered connections used in the drill string for telemetering electrical signals.

Before torquing up a rotary shouldered connection, a thread lubricant is typically applied to the pin and the box. This lubricant serves several purposes: It lubricates the threads and the shoulders of the pin and box being screwed together to prevent galling; it creates a desirable amount of preload and friction between the pin and the box under the applied makeup torque to keep them locked together during operation; and it prevents leakage through the connection by sealing off any geometrical imperfections (due to machining or handling damage) between the mating shoulders of the pin and box. Any galling of the mating threads or shoulders is detrimental not only to the mechanical functioning of the connection, but it can also create the deterioration of the electrical link due to contamination by the loose metal slivers created by the galling process. The ability of the lubricant to seal is also important from the standpoint of electrical integrity of the communication link. A leak through the joint, once started, will cause shortage and degradation of the electrical communication, in addition to causing an eventual "washout" due to erosion.

It has been known for over forty years that transmitting an electrical signal along a drill string is desirable. Various proposals have been put forth, but the connection at the pipe joint typically has been a source of breakdown in the communication link. The electrical connectors were part of the mating section of the pipe and thus during assembly and disassembly, were coated with various fluids including pipe thread lubricants. This coating would usually interfere with the transmission of the electrical signal.

The metal-to-metal contact area was relatively small and the effective contact resistance tends to vary widely due to the presence of differing amounts of relatively nonconductive fluids. One type of connector which solved this problem is disclosed in U.S. Pat. No. 3,696,332 which is assigned to Shell Oil Company. This improved connector contains a generally ring-shaped and substantially full-circle contact-making conductive metal portion that is located in an annular groove within a pipe joint element; is electrically insulated from the groove walls; and is electrically connected to a segment of the insulated electrical conductor. At least one member of each pair of mating contact-making rings is mounted adjacent to a resilient biasing means that is arranged to urge the contact-making ring toward a position from which the fluids between the rings are displaced, with a wiping action by the mating ring, as the elements of the tool joint are screwed together.

With this type of connector, a thread lubricant which is nonconductive and which provides performance characteristics similar to other metal containing thread lubricants conforming to API standards is necessary for satisfactory operation. Specifically, this thread lubricant must (1) have anti-galling characteristics to prevent seizure or damage to the tool joints, (2) have adequate lubricating properties to provide a smooth makeup, (3) provide a sealing function by bridging the geometrical imperfections (e.g.: gaps, tool marks, dents, etc.) between the sealing shoulders, and (4) have approximately the same coefficient of friction as the other thread lubricants that meet the API specifications for the drill pipe thread compounds. This coefficient of friction requirement is especially important to assure that tensile stresses created in the pin member under the API recommended makeup torque are within a safe range to avoid permanent stretch. The coefficient of friction of the thread compounds conforming to the API Specification 7 is approximately 0.08. Too low a coefficient of friction will create higher tensile stresses in the pin under the recommended API torque. Alternatively, if the reduced makeup torque is used for a low coefficient of friction thread compound to achieve the same average pin stress as used in the API specification (approximately one-half of the tensile yield strength), the torsional resistance of the tool joint to further makeup downhole is reduced. This can result in a significant damage to the drillstring (i.e.: stretched pins) as well as joints difficult to break out using normal procedures.

A pertinent prior pipe lubricant is disclosed in U.S. Pat. No. 3,526,593 which contains a hydrous calcium complex grease and between 33 and 80 percent Teflon (a trademark of DuPont for polytetrafluoroethylene). The average particle size of the Teflon is between 0.005 to 0.05 inches. Based on our tests, this type of grease would be expected to have a coefficient of friction of approximately 0.05. This low coefficient of friction will result in 60 to 70 percent higher pin stresses than with the use of API conforming thread lubricants for tool joints. It can also result in stretched pins due to further makeup downhole as described above. This thread lubricant described is best suited for sealing threaded and coupled pipe joints used in the casing and tubing, not for the drillstring rotary shouldered connections.

In another pertinent prior lubricant, U.S. Pat. No. 2,961,401, a lubricant is disclosed containing a lubricating oil grease and about 10 to 50 percent finely divided hard plant seed having a compressive strength of at least about 5,000 psi. This thread lubricant is aimed at improving leak resistance along the leakage path between the threads of a coupled joint. In rotary shouldered connections, sealing is achieved by compression of the box and pin shoulders where this lubricant offers no particular advantage.

The object of this invention is to provide a nonconductive pipe lubricant having a coefficient of friction of about 0.08, galling resistance up to 140 percent of the API recommended makeup torque and sealability up to 5,000 psi of differential pressure.

Another object of this invention is the performance of the pipe lubricant at elevated temperatures for extended periods of time.

SUMMARY OF THE INVENTION

This invention provides an improved pipe lubricant for nonconductive applications, especially in transmitting electrical signals from a down-hole location to the surface of the earth. The improved lubricant contains a base grease, a combination of hard and soft moderately deforming materials and lubricating solids.

DESCRIPTION OF THE INVENTION

The thread sealing composition of the present applications contains an effective portion of a plastic or viscous lubricating base within the range of 35 to 95 percent by weight and preferably within the range of 40 to 60 percent by weight; an effective portion of hard moderately deformable materials having a particle size range from about 50 microns to 400 microns within the range of 1 to 10 percent by weight and preferably within the range of 2.5 to 5 percent by weight; an effective portion of soft moderately deformable material having a particle size range from 20 microns to 100 microns within the range of about 20 to about 50 percent by weight and preferably within the range of 30 to 40 percent by weight; and an effective portion of lubricating solids having a particle size range from about 2 to 20 microns within the range of from about 1 to 10 percent by weight and preferably within the range of 2.5 to 5 percent by weight. More preferably the composition comprises about 30 to 35 percent by weight of soft moderately deformable material, 2.5 to 5 percent by weight of hard moderately deformable material and 2.5 to 5 percent by weight of lubricating solid material.

The plastic lubricating base may be any of the lubricating bases well known to the art. For example, the base may be a conventional grease such as cup grease consisting principally of soap and lubricating oil. By way of example, lubricating compositions which may be used as the plastic lubricating base in the present composition may be composed of oils and metal soaps, such as disclosed by U.S. Pat. No. 2,205,990 to Nelson et al, or petroleum or a metal soap grease such as disclosed in U.S. Pat. No. 2,065,248 to Smith, or aluminum soap grease and powdered lead or zinc such as disclosed in Abstract 165,377 entitled "Thread Lubricant," 662 O.G. 4, page 1188. Other greases and/or viscous lubricating oils may be employed.

If the threads are to be exposed to water, use of water-soluble soaps, such as sodium stearate, in the grease should be avoided. In an oil based drilling fluid, the grease should be selected accordingly. By far the most preferred type of grease is a lithium grease containing about 5 to 10 percent of a lithium soap of a fatty acid, such as stearic acid, in a mineral oil having a viscosity of from about 200 to about 800 seconds as measured by the Saybolt Universal viscosimeter in accordance with ASTM Test D88-53. Suitable lithium greases may be prepared by several satisfactory known methods. The grease may consist simply of a mineral oil and suitable soap. Other greases such as very viscous petroleum fractions free from soaps, may also be used as bases for the thread compounds. Such grease compositions are preferably hydrous and contain at least 1 percent by weight of water.

The moderately deforming materials used in the composition are preferably a combination of hard and soft materials with a particle size range from 20 microns to 400 microns. Any nonconducting material having the requisite resistivity, sizing and deforming physical characteristics may be employed as the moderately deforming materials.

The preferred soft moderately deforming material has a hardness range from about 0.8 to about 2.0 on Moh's scale and the hard moderately deforming material ranges from 2.0 to 3.0 on the Moh's scale. Talc which has a hardness of about 1.0 to 1.3 in terms of Moh's scale is readily available and inexpensive and for commercial reasons will usually be used as a soft moderately deforming material, but the other minerals and similar materials may be used. Suitable hard moderately deforming materials include polyimide, poly(amide-imide), polyphenylene sulfide, sepiolite, senarmontite, kaolin, calcite, brucite and barite. Some of the more preferred hard moderately deforming materials are high temperature, high strength bearings application plastics, e.g., Ryton (Phillips Petroleum's polyphenylene sulfide), Vespel (DuPont's polyimide), and Torlon (Amoco Chemicals' poly(amide-imide)).

The bridging material having the lowest resistivity will control the resistivity of the overall composition. Both the hard and soft moderately deforming materials should have resistivity greater than $10^7$ ohm-in. Preferably the resistivity is greater than $10^9$ ohm-in.

It is to be emphasized that the size and the amount of the hard and soft moderately deforming materials as well as the lubricating solids in the composition of the present invention are important in order to obtain a good makeup and sealing performance from the rotary shouldered connection. The various sizes and the ranges associated with them provide a more progressive and uniform torque versus angular rotation makeup characteristic. In addition, this mix of particle sizes also acts to more effectively block off any leakage paths between the rotary shouldered connection sealing area. By using a graded mix of particle sizes such as described in this invention, we are able to achieve a good sealing performance by bridging the gaps caused by geometrical imperfections due to machining (nicks or dents or other damage incurred during the handling process) between the sealing surfaces of the pin and the box.

Any material having the requisite sizing and lubricating characteristics discussed earlier may be employed as the lubricating solid. Examples of suitable lubricating solids are polytetrafluorethylene, fluoroethylene propylene and like materials such as perfluoroakoxy. Preferably the lubricating solid is ground polytetrafluorethylene with the particle size range from about 2 microns to 20 microns. Suitable polytetrafluorethylene resins for this purpose are commercial materials marketed by Dupont under the tradename "Teflon."

A suitable pipe thread lubricant will have a resistivity of $10^7$ ohm-in. or higher. This also means that the resistivity of each one of the constituents used in the composition described will be $10^7$ ohm-in. or higher. Preferably the resistivity of the thread compound composition as well as each one of its constituents is $10^9$ ohm-in. or higher.

As a specific example, a material having the following composition was found to give satisfactory performance in extensive tests run on a rotary shouldered connection. These performance tests included makeup torques up to 140 percent of recommended torque for the specific connection by API recommended practice 7G (API RP-7G), sealing tests up to 5,000 psi, and temperatures up to 250° F. The composition was found to give excellent anti-galling performance, sealing performance and a coefficient of friction which matched very closely the performance of the standard lead based or zinc based API thread compounds used in conventional applications.

EXAMPLE COMPOSITION OF NONCONDUCTING THREAD DOPE

| Component | Specification | Weight Percent |
|---|---|---|
| 1. Base Grease | Lithium-12 pydroxystearate with extreme pressure (EP) additive Cone penetration by ASTM D217-68 method - 330 mm | 60.0 |

-continued

| Component | Specification | Weight Percent |
|---|---|---|
| 2. Talc | Powdered (25–40 Microns) | 33.4 |
| 3. Teflon | Powdered PTFE (5–10 Microns) | 3.3 |
| 4. Ryton | Powdered polyphenylene sulfide Molding resin (250–300 Microns) | 3.3 |

DOPE CONSISTENCY

Cone penetration of the final mixture, by ASTM D217-68 Method = 285± mm (unworked)

While specific embodiments of the present invention have been described, it will be understood that these specific embodiments are given by way of illustration only and not by way of limitation.

We claim:

1. A thread sealing composition comprising:

from about 1 to about 10 percent by weight of a hard, moderately deformable material having a Moh's hardness in the range of from about 2 to about 4;

from about 20 to about 50 percent by weight of a soft, moderately deformable, electrically non-conductive material having a Moh's hardness in the range of from about 1 to about 2;

from about 1 to about 10 percent by weight of a lubricating solid having a Moh's hardness of less than about 1; and a lubricating grease base.

2. The thread sealing composition of claim 1 wherein the electrical resistivity is greater than about $10^7$ OHM-in.

3. The composition of claim 2 wherein said hard, moderately deformable material, said soft, moderately deformable material and said lubricating solid have a particle size of less than about 400 microns.

4. The composition of claim 3 wherein said lubricating solid has a particle size in the range of from about 2 to about 50 microns.

5. The composition of any of claims 1, 2, 3, or 4 wherein said lubricating solid is selected from the class consisting of polytetrafluoroethylene, fluorinated ethylene-propylene polymers, perfluoroalkoxy polymers and mixtures thereof.

6. The composition of any of claims 1, 2, 3, 4 or 5 wherein said soft, moderately deformable material comprises talc.

7. The composition of any of claims 1, 2, 3, 4, 5 or 6 wherein said hard, moderately deformable material is selected from the class consisting of polyimide resins, poly(amide-imide) resins, polyphenylene sulfide resins, sepiolite, senarmontite, kaolin, calcite, brucite, barite, and mixtures thereof.

8. The composition of any of claims 1, 2, 3, 4, 5, 6 or 7 wherein said hard, moderately deformable material is present in an amount of from about 2.5 to about 5 percent by weight, said soft, moderately deformable material is present in an amount of from about 30 to about 40 percent by weight and said lubricating solid is present in an amount of from about 2.5 to about 5 percent by weight.

* * * * *